US007249960B2

(12) United States Patent
Annecke et al.

(10) Patent No.: US 7,249,960 B2
(45) Date of Patent: Jul. 31, 2007

(54) CONTACT SAFETY DEVICE FOR PIN-AND-SOCKET CONNECTORS WITH SAFETY MECHANISM AGAINST INTERFERENCE

(75) Inventors: Alfred Annecke, Heilbronn (DE); Hans-Ulrich Mueller, Pfedelbach (DE)

(73) Assignee: Amphenol-Tuchel Electronics GmbH (DE)

( * ) Notice: Subject to any disclaimer, the term of this patent is extended or adjusted under 35 U.S.C. 154(b) by 0 days.

(21) Appl. No.: 11/291,782

(22) Filed: Dec. 2, 2005

(65) Prior Publication Data

US 2006/0128170 A1 Jun. 15, 2006

(30) Foreign Application Priority Data

Dec. 15, 2004 (DE) ..... 10 2004 060 734

(51) Int. Cl.
*H01R 29/00* (2006.01)

(52) U.S. Cl. ..... 439/188; 439/510

(58) Field of Classification Search ..... 439/188, 439/510

See application file for complete search history.

(56) References Cited

U.S. PATENT DOCUMENTS

| | | | | |
|---|---|---|---|---|
| 3,821,686 | A | 6/1974 | Harnden, Jr. | |
| 5,882,224 | A | 3/1999 | Gauker | |
| 6,726,495 | B2 * | 4/2004 | Hirschmann | 439/188 |
| 6,739,913 | B2 * | 5/2004 | Hayashi | 439/620.05 |
| 6,786,746 | B2 * | 9/2004 | Nagamine et al. | 439/188 |

FOREIGN PATENT DOCUMENTS

| | | |
|---|---|---|
| DE | 199 35 969 | 2/2001 |
| DE | 102 27 016 | 1/2004 |
| DE | 102 47 568 | 5/2004 |
| EP | 0 745 519 | 12/1996 |
| EP | 0 802 092 | 10/1997 |
| EP | 1 073 160 | 1/2001 |
| EP | 1 251 602 | 10/2002 |
| EP | 1 327 928 | 7/2003 |
| EP | 1 339 139 | 8/2003 |
| EP | 1 420 487 | 5/2004 |
| JP | 11 329 604 | 11/1999 |
| WO | WO 99/36293 | 7/1999 |
| WO | WO 03/032448 | 4/2003 |

OTHER PUBLICATIONS

European Search Report, Mar. 13, 2006.

* cited by examiner

*Primary Examiner*—Tho D. Ta
(74) *Attorney, Agent, or Firm*—Blank Rome LLP

(57) ABSTRACT

The present invention concerns a contact safety device for pin-and-socket connectors that is suited for use between a primer for airbags and a control unit of a motor vehicle, whereby a protective element in the contact safety device is provided to prevent spurious releases.

8 Claims, 4 Drawing Sheets

Figure 2:
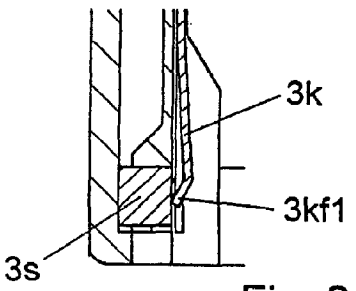

CONTACT SAFETY DEVICE FOR PIN-AND-SOCKET CONNECTORS WITH SAFETY MECHANISM AGAINST INTERFERENCE

The present invention concerns a contact safety device for pin-and-socket connectors that is suited for use between a primer for airbags and a control unit of a motor vehicle.

Electrical pin-and-socket connectors with such primers are disclosed, for example, in DE 102 27 016 A1, whereby the electrical pin-and-socket connector usually consists of an L-shaped case with a nozzle, which is inserted into the contact safety device provided in the primer. The partially complex electrical pin-and-socket connector, which often is provided with a primary and secondary lock, should have the smallest possible dimensions with the highest possible operational safety.

Due to the increasing penetration of electronics into motor vehicles the problem of their reciprocal influence on each other is also rising. Special problems lie in the fact that in a very tight space very different electronic units are housed and must operate in good order.

There are sensitive analogous devices (e.g., radio receivers, telephones, radio plants) and digital devices (e.g., injection and ignition controls ABS controls, combustion mix controls [ probes], on-board computers), as well as motor drives and control valves (e.g., dynamos, cranking motors, window openers, windshield wipers, motor fuel pumps, brake valves [ABS]) and the interference-laden ignition systems, which are to operate in this case next to one another in a very confined space. In addition to that, both the operating speed of the operational elements (band width) and the density of the operational components are increasingly rising. Sensitive sensing lines and lines for motor operators that heavily draw on voltage run close to each other over long stretches. Given this operational variety a faulty control can have disastrous consequences through their reciprocal influence (e.g., of the brake system or the airbag). In that connection special care in controlling the reciprocal influences is suggested.

It is therefore the task of the present invention to design a contact safety device for pin-and-socket connectors in such a way that spurious releases of the airbags are prevented as much as possible.

The basic idea of the present invention is to provide for a safety mechanism to secure ignition contacts of the primer against interference in securing the contact, whereby the safety mechanism is connected parallel to the ignition contacts.

A further significant aspect of the invention lies in the arrangement of the safety mechanism outside of the ignitor, especially in the isolating ring.

Varistors can be used, for instance, as a safety mechanism. Varistors are voltage-dependent resistors with symmetrical U/I characteristics. The resistance of the varistors falls with increasing voltage. Connected parallel to the protective component or connection, the varistor forms a low ohm shunt and in this way prevents a further increase of the surge voltage.

In accordance with the design of the invention the safety mechanism is designed to be integrated into the isolating ring.

The safety mechanism can, e.g., consist of two safety contact springs/MID structural component carriers, whereby each safety contact spring or each MID structural component carrier is assigned to an ignition contact of the primer, and between the contact springs a protective element, for example, a varistor, produces the contact.

The varistor, which, under certain conditions, consists of sintered zinc oxide with other metal ceramics, has a polycrystalline ceramic with predictable voltage dependency.

Through the positioning of the safety mechanism, which can contain an ESD/EMC protective element in the isolating ring, no structural changes to the ignitor itself are necessary. Furthermore, nothing changes in the assembly because one can fall back on known component parts. As a consequence, former assembly devices can also be continued to be used. Available ignitors can be combined both with ESD/EMC protected isolating rings and with conventional isolating rings with shorting bars.

Through the use of the mentioned protective elements an elimination of the shorting bars is also possible because—as described—H stress peaks are prevented anyway.

In a special design of the invention the contact of the safety mechanism can be carried out with a particular ignition contact by enclosing the ignition contact with a conducting component in every case. Both conducting components are, in turn, connected to each other through an ESD/EMC protective element. Both conducting components can be designed symmetrically or also with the same construction in an advantageous design, whereby the production costs are further lowered.

The connection of the protective element with the conducting components can take place through insertion or through simple arrangement. Other conducting connections are also conceivable, such as, for instance, clamping or screwing, whereby an easy assembly and a space-saving arrangement constitute the foremost premises.

Further designs of the invention follow from the description of the figures and the claims.

Keeping the same reference numbers for the same components, the figures in the drawings show the following in detail.

Figure 1D:
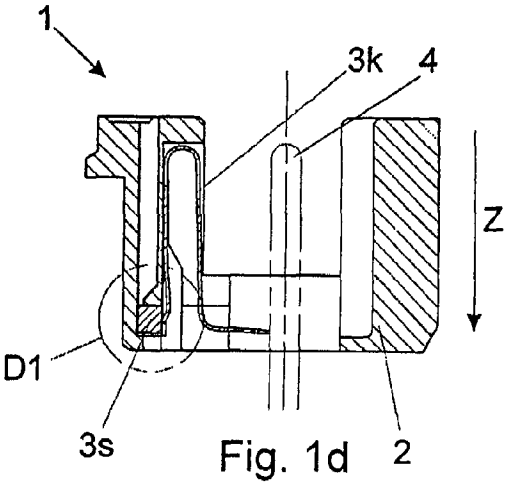
Figure 1C:
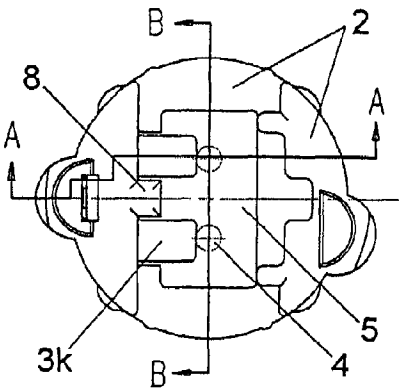
Figure 1B:
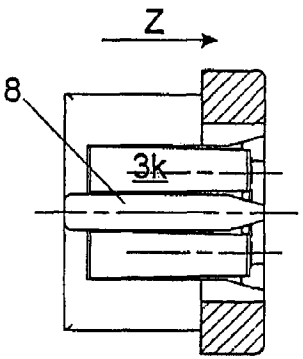

FIG. 1*a* to *d*: correctly tilted, part-sectional views of a design of the contact safety device according to the invention, whereby cut line A-A in FIG. 1*c* corresponds to the view according to FIG. 1*d* and cut line B-B in FIG. 1*c* corresponds to the view according to FIG. 1*b*

FIG. 2: detailed view of the details D1 in FIG. 1*d*

Figure 3:
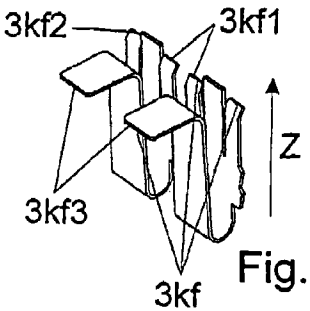
Figure 4:
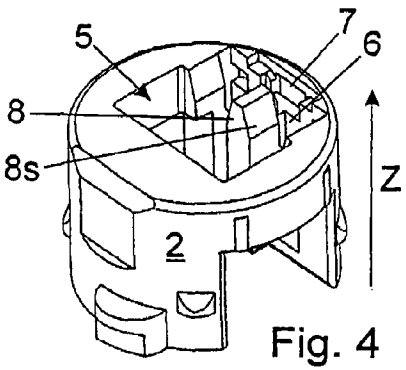

FIG. 3: perspective view of the protective contact springs according to the invention FIG. 4: perspective view of the isolating ring according to the design following FIG. 1*a* to 1*d*

Figure 5D:
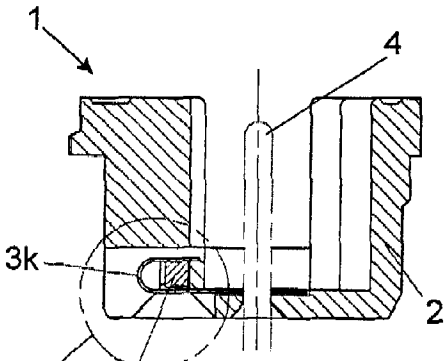
Figure 5C:
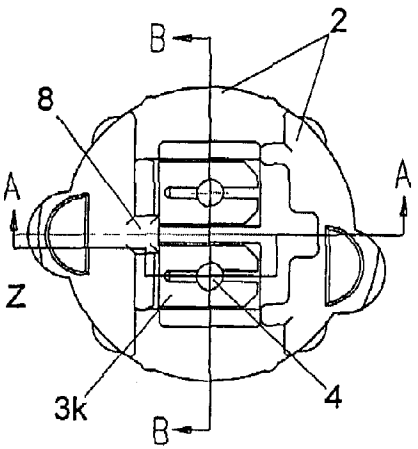
Figure 5B:
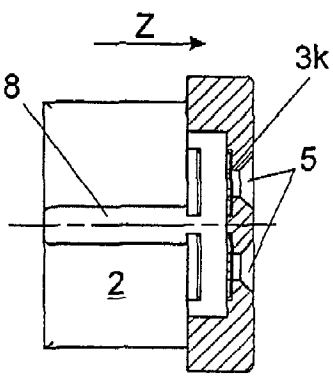
Figure 5A:
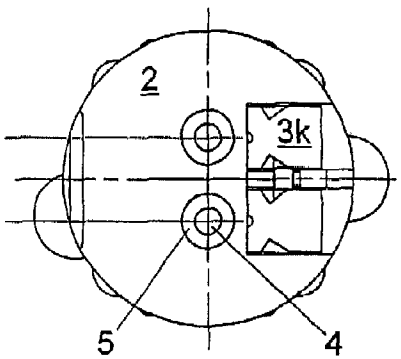

FIG. 5*a* to 5*d* tilting, part-sectional views of a design of the contact safety device according to the invention, whereby cut line A-A in FIG. 5*c* corresponds to the view according to FIG. 5*d* and cut line B-B in FIG. 5*c* corresponds to the view according to FIG. 5*b*

Figure 6:
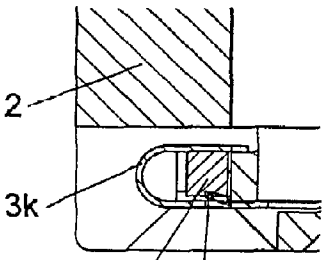

FIG. 6: detailed view of the details D2 in FIG. 5*d*

Figure 7:
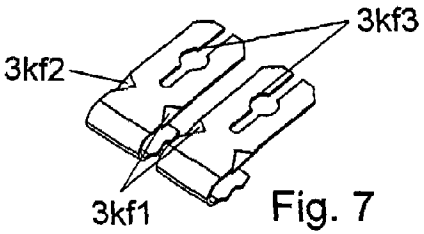
Figure 8:
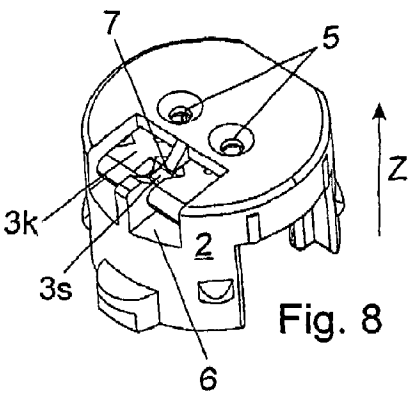

FIG. 7: perspective view of the protective contact springs according to the invention FIG. 8: perspective view of the isolating ring in accordance with the design according to FIG. 5*a* to 5*d*

Figure 9D:
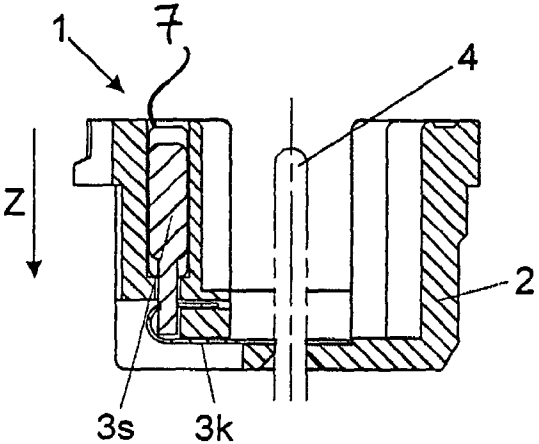
Figure 9C:
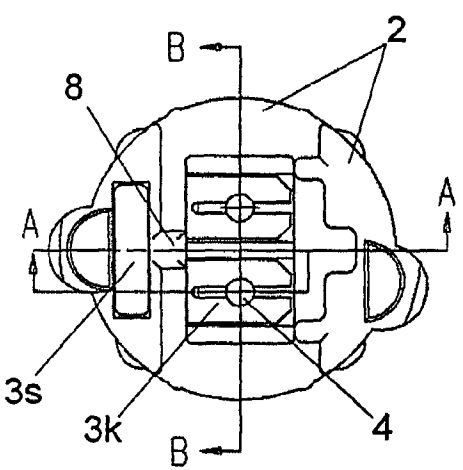
Figure 9B:
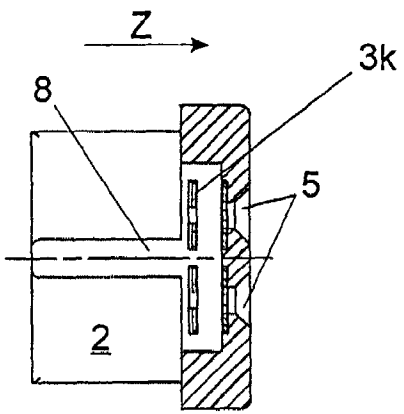
Figure 9A:
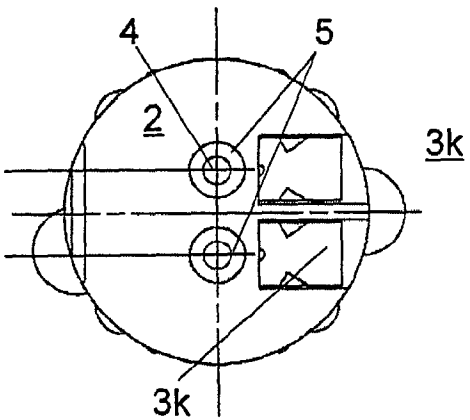

FIG. 9*a* to 9*d*: tilting, part-sectional views of a design of the contact safety device according to the invention, whereby cut line A-A in FIG. 9*c* corresponds to the view according to FIG. 9*d* and cut line B-B in FIG. 9*c* corresponds to FIG. 9*b*

Figure 11:
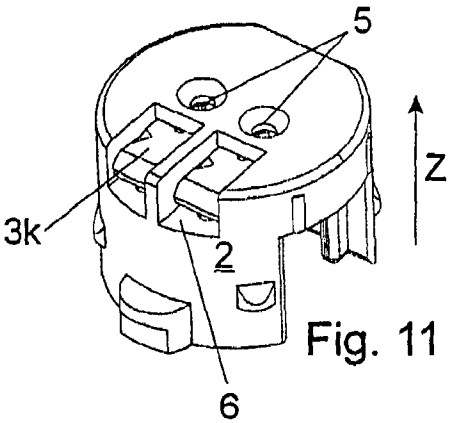
Figure 10:
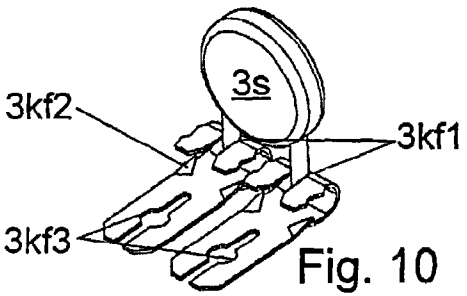

FIG. 10: perspective view of the protective contact springs according to the invention FIG. 11: perspective view of the isolating rings according to the design following FIG. 9*a* to 9*d*

Figure 12D:
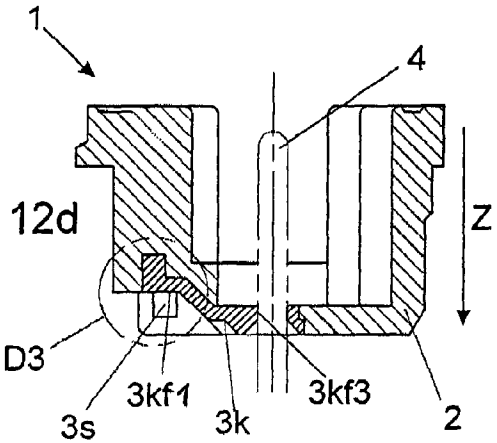
Figure 12C:
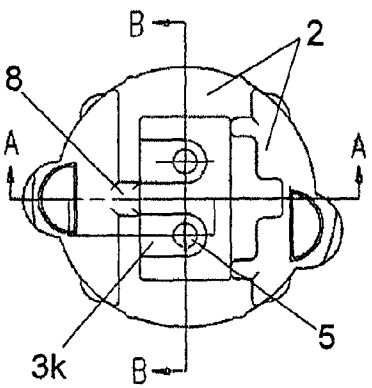
Figure 12B:
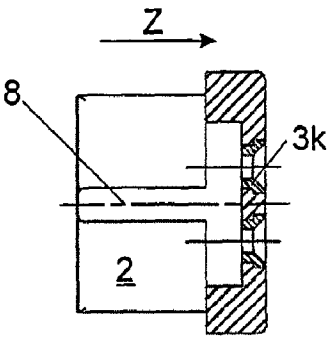

FIG. 12*a* to 12*d*: tilting, part-sectional views of a design of the contact safety device according to the invention, whereby cut line A-A in FIG. 12*c* corresponds to the view according to FIG. 12*d* and cut line B-B in FIG. 12*c* corresponds to the view FIG. 12*b*

Figure 13:
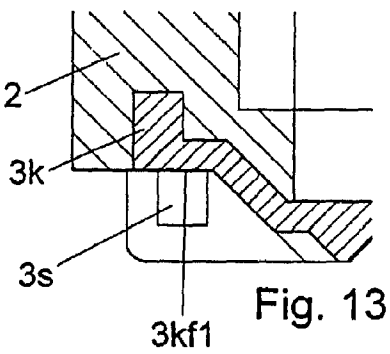

FIG. 13: detailed view of the details D3 in FIG. 12*d*

Figure 14:
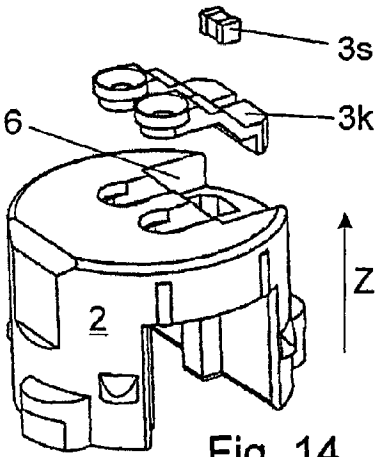
Figure 12A:
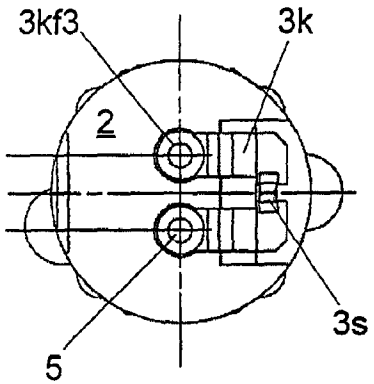

FIG. 14: perspective exploded view of the MID structural element carriers, the protective element, and the isolating ring according to the design of the invention following FIG. 12*a* to 13 and 15

Figure 15:
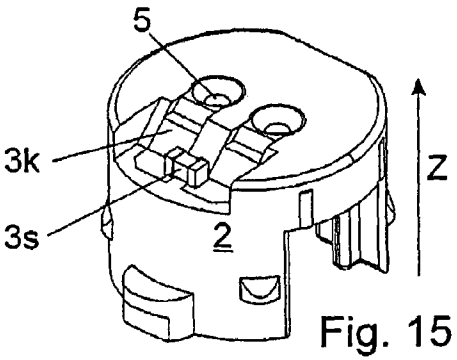

FIG. 15: perspective view of the isolating ring according to the design following FIG. 12*a* to 12*d*

In the figures the primers, pin-and-socket connectors, and locking elements are not shown or are only incompletely shown, and they are assumed to be known. In the working examples described here the outer dimensions of the contact safety device are essentially identical. They, however, are/can be adapted to every other geometric shape of primers/pin-and-socket connectors. Locking elements that are partially shown also are not explained further.

FIG. 4 shows a contact safety device 1 in a perspective view, which consists chiefly of an isolating ring 2 of a complex geometrical form. Essentially it is cylinder shaped and has at least one opening 5 in the ignition direction Z—an opening through which the contact springs 4 of the primer (not shown) extend. In ignition direction Z a gas generator, which can be ignited, and an airbag connect in a conventional way.

The isolation ring 2 has, furthermore, in ignition direction Z an open contact spring recess 6, in which the protective contact springs 3*k* are inserted during pre-assembly after a protective element 3*s* (see FIG. 1*d*) is placed in a protective element pocket 7 next to the contact spring recess 6.

Figure 1A:
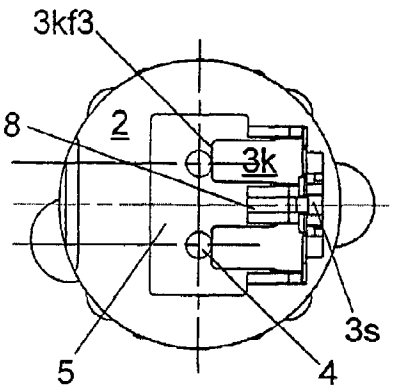

In FIG. 1*a* the protective contact springs 3*k* are placed in the protective contact spring recess 6, whereby the protective element 3*s* is held in the protective element pocket 7 by means of the outward extending protective contact ends 3*kf* of the protective contact spring 3*k*.

In this way the contact between the two protective contact springs will also be secured. The protective element 3*s* can, for example, be a varistor. The protective contact ends 3*kf* of the protective contact springs 3*k* can be gold-plated to guarantee a high conductivity and long wear. The protective element 3*s* is connected to the protective contact springs 3*k*, preferably through a soldered joint.

With the ends of the protective contact springs 3*k*, which are aimed inward, each of the protective contact springs 3*k* contact each of the contact springs 4 of the primer. Interference, such as, for example, spikes in voltage, are to be balanced out through the properties of the varistor/protective element 3*s* described above.

A spring arm 8 shown in FIGS. 1*a*, 1*b*, and 4 serves to hold the protective contact springs 3*k* as well as to guide them during the pre-assembly. To make the pre-assembly easier the the spring arm 8 can have conically running exterior faces 8*s* on its ends.

In FIGS. 1*c* and 1*d* one can see that the cylinder shape is open in a U shape against the ignition direction Z in order to receive a nozzle of a pin-and-socket connector, which is not shown, to connect to a control unit.

In FIG. 1*d* the position of the protective elements 3*s*, integrated into the isolating ring 2, is clear according to the working model, which is why in the detailed view in FIG. 2 the details D1 in FIG. 1*d* are shown enlarged. The above-mentioned clamping of the protective element 3*s* is brought about by the spring action of the protective contact spring 3*k* and with the contact ends 3*kf*1, which are bent in the direction of the protective element 3*s*.

The two protective contact springs 3*k* in FIG. 3 each have a U shaped basic form, whereby a side of the U shape is turned away and outward and the turned away end forms the contact 3*kf*3 with the assigned contact spring 4. The other side of the U shape of the protective contact 3*k* is divided into three sections on its end, whereby the section lying inside or aimed at the other protective contact spring 3*k* produces the contact 3*kf*1 to the protective element 3*s* on its end and is bent outward to secure the protective element 3*s* in the protective element pocket 7.

The outer section of the U shape of the protective contact spring 3*k* or the section bent away from the other protective contact spring 3*k* serves to lock the protective contact spring 3*k* into the isolating ring 2, as it is also bent outwards on its end. By inserting the protective contact spring 3*k* in the protective contact spring recess 6, the latch area 3*kf*2 of the section lying outward on an inner surface of the isolation ring 2 slides into the protective contact spring recess 6, but can be moved back in the opposite direction only with difficulty due to the spring action aimed against the isolating wall and the locking action. FIGS. 5*a*, 5*b*, 5*c*, 5*d*, 6, 7, and 8 show a further design of the invention, which essentially differs from FIGS. 1*a* to 4 through the arrangement of the protective contact springs 3*k* and the protective element 3*s*, as well as the respective matched protective contact spring recess 6 and the protective element pocket 7.

In FIG. 8 it can be clearly seen that the protective contact springs 3*k* are no longer inserted parallel to the ignition direction in contrast to the working model according to FIG. 8, but are also essentially orthogonal to the ignition direction in corresponding protective contact spring recesses 6 of the isolation ring. In the protective contact spring recess 6 a partition wall is provided, which separates the protective contact spring recess 6 into two pockets. The partition wall in this case has the protective element pocket 7 for receiving the protective element 3*s*. The two pockets of the protective contact spring recess 6 are so positioned that the protective contact springs 3*k* are secured by inserting each before an opening 5 for the contact springs 4. Pulling out the protective contact springs 3*k* is prevented by the latch area 3*kf*2 (see FIG. 7) lying outside of the protective contacts 3*k*. Each protective contact spring 3*k* encloses in the contact area 3*kf*3 a contact spring 3*k* in each case so that a conducting connection between the contact springs 4 over the protective element 3*s* exists, which provides a connection on the other end of the protective contact springs 3*k*.

FIGS. 9*a*, 9*b*, 9*c*, 10, and 11 show a further design of the invention, which is the same as the aforementioned design according to FIGS. 5*a* to 8. The design differs according to FIGS. 10 and 11 in the arrangement of the protective elements 3*s*, which in this case extend in a side arm of the U shaped isolating ring 2. The protection contact springs 3*k* are also inserted, as in FIG. 8, orthogonal to the ignition direction Z in the isolating ring 2. The connection between the two protective contact springs 3*k* are produced through the contact 3*kf*1 by inserting the protective element 3*s* after inserting the protective contact springs 3*k* in the protective contact spring recess 6 in the protective element pocket. The contact of the contact springs 4 takes place as described above with FIG. 8.

FIGS. 12*a*, 12*b*, 12*c*, 12*d*, 13, 14, and 15 describe a further working model of the invention, whereby in this case the protective contact springs 3*k* are designed as MID (moulded interconnect devices) structural component carriers and accordingly have no or hardly any spring function because they are made of plastic with conducting component parts/coatings.

The geometric arrangement of the MID structural component carriers 3*k* in the isolating ring 2 is similar to the working models described previously with FIGS. 8 and 11. The MID structural component carriers 3*k* are, nonetheless, not inserted into the isolating ring 2, but are put in a correspondingly designed protective contact spring recess 6. An end of the MID structural component carriers serve in each case to enclose the contact spring 4 and also form with it the opening 5. Through the use of MID structural elements an extremely space-conserving, geometrically easily adaptable method of construction of the isolation ring 2 is made possible. The contact 3*kf*1 between protective element 3*s* and the two MID structural component carriers is shown in FIG. 12*d* and in detail D3 in FIG. 13.

The isolating ring 2, shown in FIG. 14 as an exploded drawing, is preferably produced together with the two MID structural component carriers 3*k* in an injection process, whereby the production of both structural components can take place in one phase, i.e., together. The protective element 3*s* is brought into contact with the two MID-structural component carriers 3*k* and secured on it, in particular by means of a soldered joint.

Contact Safety Device for Pin-and-Socket Connectors with Safety Mechanism Against Interference

LIST OF REFERENCE NUMBERS

1 contact safety device
2 isolating ring
3 safety mechanism
3*s* protective element
3*k* protective contact spring/MID structural component carrier
3*kf* contact end of the protective contact springs/MID structural component carriers
3*kf*1 contact end for protective element
3*kf*2 latch area in isolation ring
3*kf*3 contact end for contact springs
4 contact spring
5 opening
6 protective contact spring recess
7 protective element pocket
8 spring arm
8*s* conically running exterior faces
Z ignition direction

The invention claimed is:

1. Contact safety device for pin-and-socket connectors, suited for use between a primer for airbags and a control unit of a motor vehicle, comprising:

an isolating ring, and a safety mechanism for securing contact springs of the primer against interference, whereby the safety mechanism is connected parallel to the contact springs wherein the safety mechanism consists of a protective element and two protective contact springs, whereby the protective contact springs contact each of the contact springs with their contacts and the protective element produces a working connection between the protective springs.

2. Contact safety device according to claim 1, in which the safety mechanism is integrated into the isolating ring.

3. Contact safety device according to claim 1, in which the protective element is secured in a protective element pocket of the isolating ring through contacts of the protective contact spring.

4. Contact safety device according to claim 1, in which the protective element is a varistor.

5. Contact safety device according to claim 1, in which the protective contact springs surround each of the assigned contact springs with their contacts.

6. Contact safety device according to claim 1, in which the protective element is positioned parallel to an ignition direction Z.

7. Contact safety device according to claim 1, in which the protective element is positioned orthogonal to an ignition direction Z.

8. Pin-and-socket connector with contact safety device according to claim 1.

* * * * *